United States Patent [19]

Sarazen, Jr. et al.

[11] Patent Number: 4,669,371

[45] Date of Patent: Jun. 2, 1987

[54] VENTILATOR MOUNTING SPRING

[76] Inventors: Paul M. Sarazen, Jr., 214 Fairview Dr.; Dennis Beam, 410 Westfield Rd., both of, Shelby, N.C. 28150

[21] Appl. No.: 822,324

[22] Filed: Jan. 27, 1986

[51] Int. Cl.[4] ..... F24F 13/18

[52] U.S. Cl. ..... 98/29; 52/573; 98/114; 248/27.3

[58] Field of Search ..... 98/1, 29, 37, 101, 106, 98/107, 108, 114; 52/208, 217, 573; 248/27.1, 27.3

[56] References Cited

U.S. PATENT DOCUMENTS 3,955,483 5/1976 Sunter ..... 98/108 X
4,531,335 7/1985 Mangan ..... 52/208

FOREIGN PATENT DOCUMENTS 1168043 4/1964 Fed. Rep. of Germany ..... 98/114

*Primary Examiner*—Harold Joyce

*Attorney, Agent, or Firm*—Dority & Manning

[57] ABSTRACT

A spring clip for mounting a ventilator in an opening provided in a foundation or other wall structure. Preferably, two spring clips are used to retain the ventilator in the opening, one spring clip on each side of the ventilator. Each spring clip is made of resilient material and includes a front end adapted for attachment to the ventilator, a bulged intermediate portion which is deflected inwardly upon insertion of the ventilator in the opening, and a rear end located adjacent a side wall of the ventilator and which slides along the side walls as the bulged portion is deflected. The bulged portion presses against the side of the ventilator and a side of the opening in an elastic manner to retain the ventilator in the opening by frictional engagement. The need is eliminated for fasteners other than the spring clips in order to securely retain the ventilator in the opening. The need to modify the opening to allow the ventilator to be retained therein by conventional fasteners is also eliminated.

20 Claims, 7 Drawing Figures

VENTILATOR MOUNTING SPRING

BACKGROUND OF THE INVENTION

The present invention relates to a spring clip for installation of a ventilator structure of the type that is normally disposed in the foundation of a dwelling or other type of building structure. Ventilators are normally spaced around the periphery of a building, dwelling structure, or the like to permit proper ventilation beneath the floor level of the building or structure. Ventilators are usually provided with one or more louvers or shutters which are movable between a closed position, that generally cuts off air flow through the ventilator, and an open position, which permits air flow from the outside to underneath the building or structure.

Normally, ventilators are placed within foundation openings designed specifically therefor, and are secured in place with mortar, pins, screws or the like. In new construction, openings for ventilators are usually provided in the foundation during construction of the foundation or underpinning of the structure. The openings are sized particularly for the ventilators to achieve a proper fit. In an existing structure where a ventilator is to be replaced due to age, damage, or for some other reason, it is desirable that the existing ventilator being capable of easy removal and that the replacement ventilator be capable of easy installation. It is also desirable that the ventilator opening in the foundation wall receive the ventilator with a good fit so that the interior of the foundation wall will be substantially closed to passage of insects, leaves, etc. around the ventilator structure.

A ventilator mounting spring clip constructed in accordance with the present invention is economical to manufacture, and allows easy installation and removal of a ventilator into a ventilator opening of a foundation wall without requiring modification to the wall bordering the ventilator opening. The need is eliminated for preparing the ventilator opening for receipt of conventional ventilator fastening devices such as screws, pins, bolts or the like as are used with a ventilator, exemplified by the disclosure in U.S. Pat. No. 4,493,456. In like fashion, mortar or the like which is also conventionally employed would not be needed. The present invention thus affords an improved and economical means for the mounting of foundation ventilators.

No prior art is known to exist which teaches or suggests mounting clips according to the present invention, whether for manually operated or automatic ventilators.

SUMMARY OF THE INVENTION

It is an object of the present invention to provide a ventilator mounting spring which will secure a ventilator in an unmodified foundation opening for a ventilator.

Another object of the present invention is to provide a ventilator mounting spring which allows a ventilator to be installed in or removed from a foundation opening for same without using any tools.

Another object of the present invention is to provide a ventilator mounting spring which allows a ventilator to be installed in foundation openings of various sizes, while providing proper installation to preclude ingress of leaves, insects or the like therethrough.

Yet another important object of the present invention is to provide a ventilator mounting means which is of simple design and which is easy to manufacture.

Still further, another object of the present invention is to provide a foundation ventilator having mounting means incorporated therewith for installation within a foundation opening without the use of tools.

Generally speaking, the ventilator mounting means according to the present invention comprises an elongated strip of resilient material, said strip having means located at a first end for securement to a portion of a ventilator structure, said strip means further having an intermediate portion that deviates from linearity to define a compressible force applying section and an end adjacent said compressible section that is adapted for movement in a direction away from said securement means when said compressible section is compressed.

More specifically, the mounting means according to the present invention is a spring means, one end of which is adapted for attachment to a portion of a ventilator housing with the body of the spring means extending rearwardly therefrom to reside freely along a side of the ventilator housing. An end of the spring means opposite the attachment means is adapted to reside adjacent a side of the ventilator housing with an intermediate section that is preferably generally V-shaped with the vertex of the V extending away from the ventilator housing. With the mounting means attached to a ventilator housing, upon insertion into a foundation opening for a ventilator, the V-shaped section is flattened by walls defining the opening. As the V flattens, the end of the spring opposite the attachment means moves along the ventilator housing, whereby tension in the spring holds same against the adjacent wall, thereby securing the ventilator within the opening.

In one embodiment, the attachment means is a generally U-shaped portion of the spring that serves as a clip while in another embodiment, a portion of the spring is adapted for secure receipt within a portion of the ventilator housing.

BRIEF DESCRIPTION OF THE DRAWINGS

The foregoing as well as other objects of the present invention will be more apparent from the following detailed description of the preferred embodiment of the invention, when taken together with the accompanying drawings, in which.

BRIEF DESCRIPTION OF THE INVENTION

Figure 1:
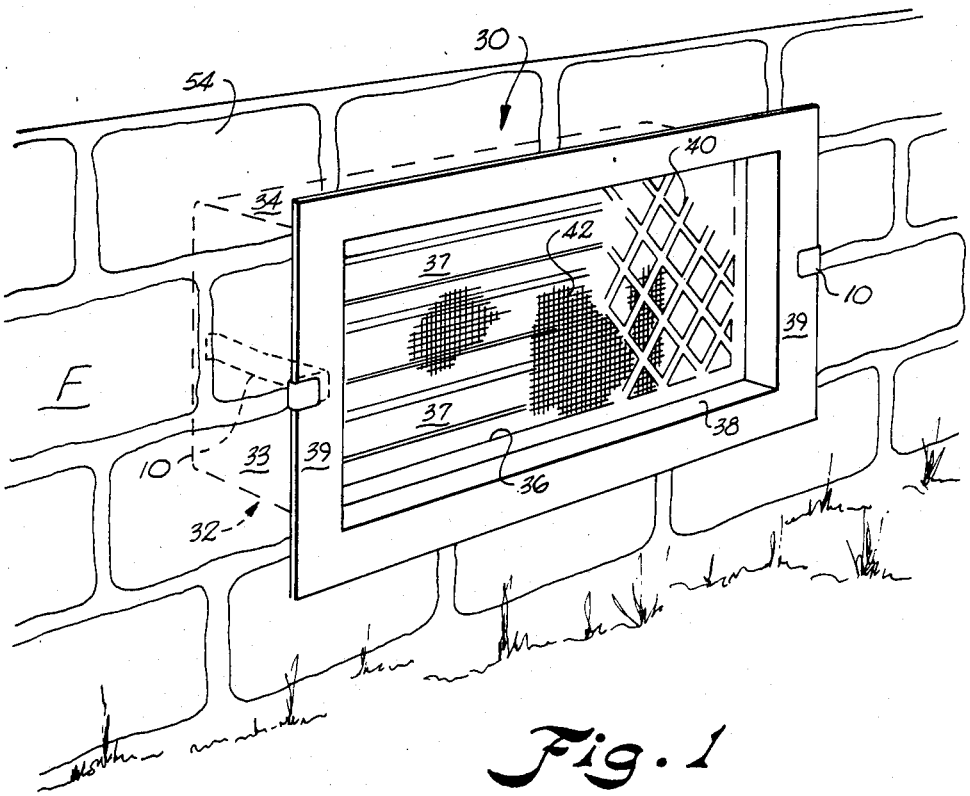
FIG. 1 is a perspective view of a preferred form of ventilator equipped with a resilient mounting means according to the present invention, as seen installed in a ventilator opening of a brick foundation wall of a building.

Referring to the drawings, a mounting means generally 10 is illustrated in FIG. 1 attached to a ventilator structure generally 30 for retaining ventilator 30 in a ventilator opening 14 of a building foundation F.

Ventilator 30 may be manually or automatically operated and generally includes a ventilator housing 32 which is formed of side walls 33, and top and bottom walls 34 and which defines an air passageway 36 therethrough. One or more shutter elements 37 is mounted within air passageway 36 for movement between open and closed positions. In preferred ventilator structures, a plurality of shutter elements 37 are employed and are interrelated for joint movement by the action of a thermally responsive element (not shown). For example, ambient temperature controls the position of the shutter elements. At a temperature of about 30° F., the shutters are completely closed and at about 70° F. the shutters are completely open permitting air passage thereby. Ventilators 30 further are preferably provided with a collar 38 that is located about housing 32 at a front end of same and includes a flange 39 which extends transversely with respect to passageway 36 for a distance adequate to ensure complete closure of a foundation opening in which the ventilator is to be installed. Collar 38 may be of unitary construction with housing 32 or securable thereto. A gridwork 40 is also generally provided for ventilator 30 backed by screen wire 42 or the like which reduces ingress of insects and the like through ventilator 30. Gridwork 40 and a wire 42 are most preferably included on both ends of ventilator 30 and on at least one end is removable to facilitate cleaning of the interior of the ventilator.

Historically, as noted above, ventilators 30, whether installed in new construction or as replacement ventilators, have been secured within the foundation openings by mortar, nails, screws, bolts or the like. All such conventional means of securement involve the use of tools. With the present invention, no such tools are required, and a ventilator equipped with the present mounting means can very simply be pressed into the foundation opening. The present invention thus reduces the time of installation, the cost of installation, and provides for ease of removal of the ventilator for replacement or cleaning.

Mounting means 10 is illustrated in FIGS. 1, 2, 4 and 4A as a spring clip, which is preferably made of a resilient material such as spring steel or any other suitable metal or plastic. Spring clip 10 includes a forward end generally 12, a V-shaped intermediate section generally 18, and a rear end section generally 20. Forward end 12 of the preferred embodiment of the present invention shown in FIGS. 1, 2, 4, and 4A, defines a generally U-shaped portion having a leg 13 adjacent V-shaped portion 18 with a resilient flap 15 that extends inwardly toward an opposite leg 14 of U-shaped portion 12. Clip 10 is attached to ventilator 12 by sliding U-shaped end portion 12 over a portion of peripheral flange 39 of collar 38 such that resilient flap 15 is compressed towards leg 13.

The V-shaped intermediate portion 18 of spring clip 10 extends outwardly from ventilator side wall 33 and includes a first or forward leg 22, a vertex portion 24, and a second or rear leg 26. Forward leg 22 extends from adjacent forward end 12 of clip 10 to vertex portion 24. Rear end 20 of clip 10 preferably includes an outwardly curved terminal end 21, the purpose of which will be described hereinafter. Also as shown in FIGS. 1 through 4A, clip 10 is preferably of unitary construction, with the single length of resilient material being bent, die cut or otherwise formed into the desired configuration.

Figure 2:
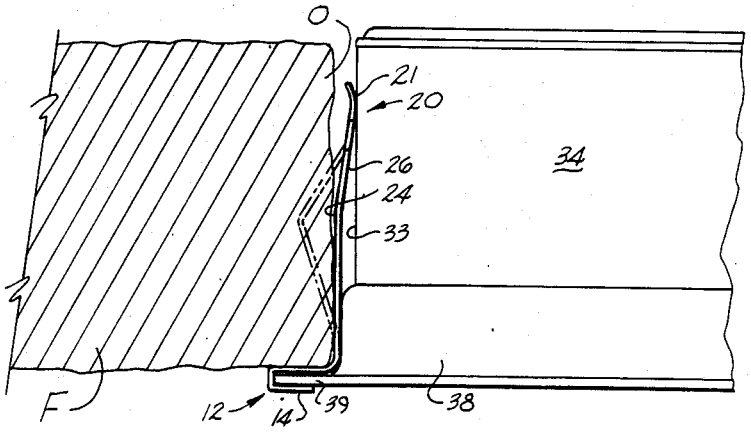
FIG. 2 is a fragmentary plan view of a preferred form of ventilator spring clip of the present invention as seen installed in a foundation ventilator opening.

As illustrated in FIG. 2, and as typical, opening O in foundation F is not specifically sized to the particular ventilator to be received therein, and normally is larger than the exterior dimensions of the ventilator housing. Hence, with an appropriate number of clips 10 attached to flange 39 and residing against the respective wall or walls of housing 32, an end of housing 32 opposite flange 39 is inserted into opening O. As ventilator 30 is then forced inwardly, rear leg 26 of V-shaped sections 18 of clip 10 is engaged at leg 26 by foundation F and V-shaped section 18 begins to collapse in a direction of ventilator 30. As V-shaped section collapses or flattens, rear end 20 of clip 10 moves in a direction away from flange 39 to accommodate the increase in length. Such movement is facilitated by curved terminal end 21. Once ventilator 30 is fully inserted into opening O, clip 10 is generally flattened as shown in FIG. 2, though the degree of flatness depends upon the amount of space between the relevant housing wall and foundation F. In a generally flattened condition, the resilient memory of clip 10 at V-shaped section 18 continues to apply a holding force against foundation wall F to secure ventilator 20 within opening O. Such force is, in fact, proportional to the extent to which V-shaped portion 18 of clip 10 is flattened. Thereafter, if desired, the force of spring clip 10 can be overcome for removal of the ventilator.

Forward leg 22 of U-shaped portion 18 extends from vertex 24 to adjacent attachment means 12. When spring clip 10 has been attached to peripheral flange 39 of ventilator 30, and before ventilator 30 has been inserted in opening O, the angle of rear leg 26 with respect to ventilator 30 has been inserted in opening O, the angle of rear leg 26 with respect to ventilator side wall 33 is preferably greater than the like angle of forward leg 22.

Figure 3:
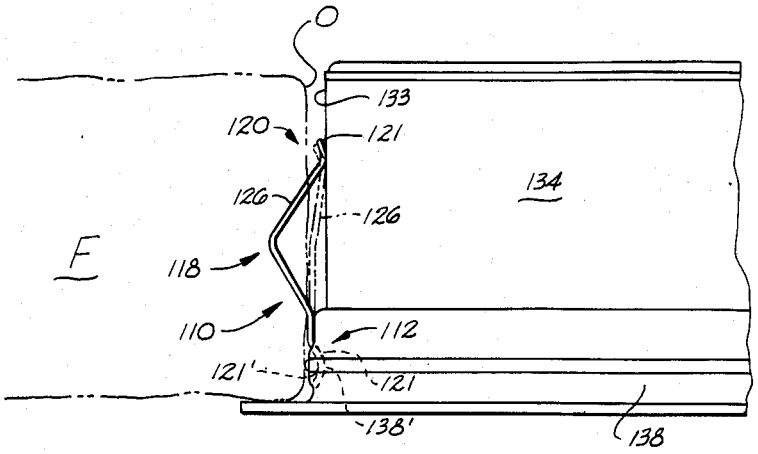
FIG. 3 is a fragmentary plan view of an alternate embodiment of a ventilator spring clip of the present invention as seen installed in a foundation ventilator opening.
Figure 4:
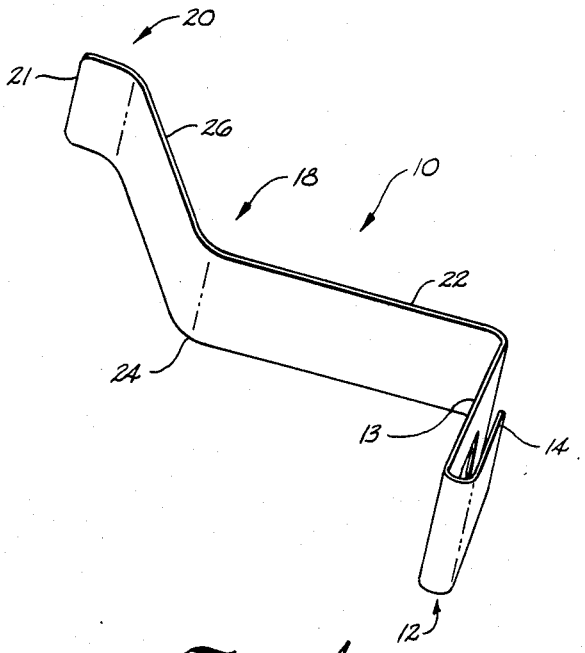
FIG. 4 is a perspective view of a preferred form of a ventilator spring clip of the present invention.
Figure 4A:
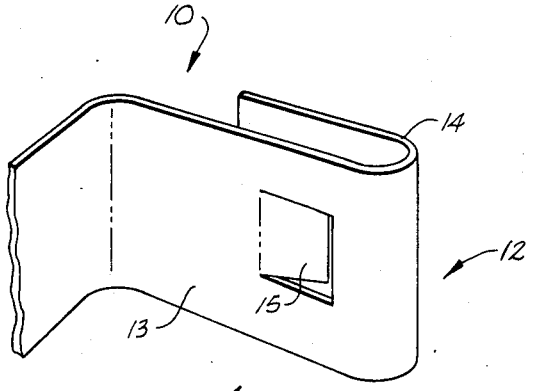
FIG. 4A is a fragmentary perspective view of an end of a preferred form of a ventilator spring clip of the present invention.

A further embodiment of the spring clip of the present invention is illustrated in FIG. 3. Spring clip generally 110, has a forward end generally 112, a U-shaped intermediate portion generally 118, and a rear end generally 120. Forward end 112 is curved inwardly defining a curved knuckle 121 which is received in an indentation 138' in collar 138 of ventilator 130. Curved knuckle 121 is held in indentation 138' by a C-shaped clip 145 which spans across the upper side of collar 138 and presses against a back side 121' of curved knuckle 121, to thereby retain forward end 112 in indentation 138' and secure clip 110 to ventilator 130. Other than the means by which curved end 112 is attached to collar 138, spring clip 110 functions in substantially the same manner as does spring clip 10, with V-shaped portion 118 deflecting inwardly as foundation F engages leg 126 during insertion of vent 130 into opening O.

Figure 5:
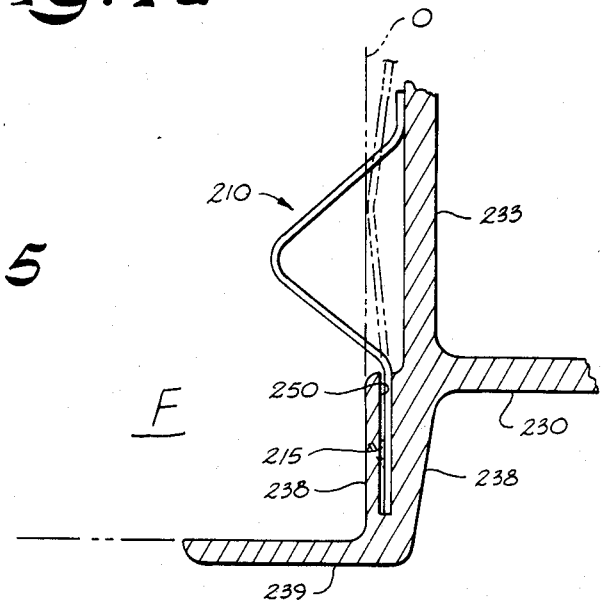
FIG. 5 is a sectional view of an alternate embodiment of a ventilator spring clip of the present invention as seen attached to a ventilator housing.
Figure 6:
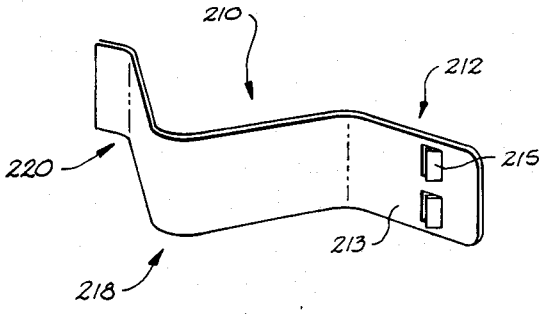
FIG. 6 is a perspective view of the alternate embodiment of the ventilator spring clip shown in FIG. 5.

In FIGS. 5 and 6, yet a further preferred embodiment of spring clip 210 is illustrated having a forward end generally 212, an intermediate curved section generally 218 and a rear end generally 220. Forward end 212 of spring clip 210 has a substantially straight section 213 with at least one, but preferably two, outwardly projecting resilient flaps 215. Straight forward end 212 is attachable to ventilator 230 by inserting same into a slot 250 as defined in collar 238. Upon insertion of straight forward end 212 into slot 250, resilient flaps 215 are compressed, as their height is greater than the height of slot 250 and tend to bite into an inside wall of slot 250. Resilient flaps 215 thus retain straight forward end 212 within slot 250, thereby securing spring clip 210 to collar 238 of ventilator 230.

As can be seen in the Figures, intermediate section 218 is curved to define more of a bulged section than a V as shown in FIGS. 1 through 4A. In fact, other shapes are likewise permissible so long as the intermediate section of the spring clip deviates from linearity to deflect upon insertion of the ventilator into the opening and apply a holding force between the ventilator housing and foundation wall adequate to retain the ventilator within the opening. Such type intermediate section may be employed with any of the embodiments of the invention.

With the spring embodiment illustrated in FIGS. 1, 2, 4 and 4A, no modification to the ventilator structure is required for certain types now commercially available, though a portion of forward end 12 of clip 10 would be visible in front of flange 39. Conversely, the ventilator-clip combinations of FIGS. 3, 5 and 6 conceal the spring clip from view.

After a spring clip constructed in accordance with the present invention is appropriately attached to a ventilator, the ventilator is simply grasped by hand on both sides and pressed into the foundation opening. Preferably, at least one spring clip is placed on at least two opposing sides of the ventilator prior to installation. Removal of the ventilator from the ventilator opening is merely a reversal of the installation process, and is accomplished by grasping the ventilator by hand and pulling the ventilator from the ventilator opening.

While preferred embodiments of the invention have been described using specific terms, such description is for illustrative purposes only, and it is to be understood that changes and variations may be made without departing from the spirit or scope of the following claims.

What is claimed is:

1. A mounting spring for securing a ventilator within a walled opening, the ventilator having a peripheral flange and a plurality of sidewalls, the spring comprising:

a length of resilient material having a forward end configured to removably frictionally engage the ventilator for attaching the spring to the ventilator, a bulged intermediation portion and a rear end extending from said bulged intermediate portion and adapted for sliding engagement with the ventilator;

whereby when the spring is attached to the ventilator and the ventilator is inserted into the walled opening, said bulged portion engages the walled opening and in engaging the walled opening said bulged portion substantially flattens and applied pressure against the walled opening sufficient to secure the ventilator within the walled opening.

2. A mounting spring as in claim 1, wherein:

said rear end defines a curved terminus, whereby as said bulged portion substantially flattens upon insertion of the ventilator attached to the spring, within the walled opening, said curved terminus slides along a side wall of said ventilator.

3. A mounting spring as in claim 1, wherein:

said bulged portion is a generally V-shaped portion comprising a vertex portion, a first leg and a second leg, said legs being joined by said vertex portion.

4. A mounting spring as in claim 3, wherein said second leg has a steeper slope than has said first leg relative to a side wall of said ventilator.

5. A mounting spring as in claim 1, wherein:

said forward end defines a generally U-shaped portion for receipt about a portion of a ventilator flange extending in the same direction as said bulged portion.

6. A mounting spring as in claim 5, wherein:

a portion of said U-shaped portion defines a resilient flap for engagement against said flange.

7. A mounting spring as in claim 1, wherein:

said forward end defines a curved knuckle portion shaped to mate to the curvature of an indentation formed in a sidewall of a ventilator.

8. A mounting spring as in claim 1, wherein:

said forward end forms a substantially straight portion having at least one resilient flap portion extending away from said straight portion, whereby upon insertion of said straight portion into a slot formed in the sidewall of the ventilator, said flap presses against the inner surface of the slot.

9. A spring for mounting a ventilator within an opening in a foundation, comprising a length of spring steel having a forward end configured to removably frictionally engage the ventilator for attaching the spring to the ventilator, a bulged intermediate portion and a rear end, said forward end of said spring being configured for attachment to a portion of a ventilator with said spring residing along a side wall of said ventilator with said bulged intermediate portion being located away from said side wall, and said rear end being curved to define a surface to slide along said side wall, whereby when said spring is attached to a ventilator and the ventilator is inserted into a foundation opening therefor, said bulged intermediate portion is collapsed in a direction toward said side wall with said curved rear end sliding along said side wall during said collapse, and wherein in the collapsed state, the bulged intermediate portion imparts a holding force against said foundation.

10. A mounting spring as defined in claim 9 wherein said forward end is straight and said bulged portion is generally V-shaped, with a leg of the V adjacent said rear end having a steeper slope than an opposite leg thereof.

11. A mounting spring as defined in claim 9 wherein said forward end defines a generally U-shaped section for receipt about a portion of a ventilator and said bulged portion is generally V-shaped.

12. A foundation ventilator, comprising:

(a) a ventilator housing, said housing having side walls defining an air passageway therethrough;

(b) at least one shutter element mounted within said housing for movement between an open position and a closed position; and (c) at least one mounting spring having a forward end configured to removably frictionally engage said housing for attaching said mounting spring to said housing and residing along an exterior surface of a side wall thereof, said spring also having a bulged intermediate portion adjacent said forward end and a free end adjacent said bulged portion, whereby when said ventilator is inserted into a foundation opening therefor, said foundation collapses said bulged portion toward said side wall with said free end of said spring sliding therealong to develop a holding force adequate to retain said ventilator within said foundation opening.

13. A ventilator as defined in claim 12 wherein said ventilator housing defines a collar adjacent an end of same to reside outside the foundation, said collar having a laterally extending peripheral flange, and wherein said spring defines a generally transversely extending U-shaped section, said U-shaped section being received about a portion of said flange to attach said spring to said ventilator.

14. A ventilator as defined in claim 12 wherein said ventilator housing includes a collar adjacent an end of same to reside outside the foundation, said collar having a laterally extending peripheral flange, said collar defining at least one spring receiving area therein, and wherein an end of said spring is received within said spring receiving area.

15. A ventilator as defined in claim 14 wherein said spring end received in said spring receiving area is straight and includes at least one protruding flap for holding engagement with said collar thereat.

16. The combination of a ventilator for insertion into a walled opening and a mounting spring for securing the ventilator within the opening, the combination comprising:

a ventilator having a collar and a housing, said collar having a peripheral flange attached to a plurality of collar side walls, said housing having a plurality of housing walls;

a mounting spring comprising a strip of resilient material having a generally V-shaped portion, said V-shaped portion comprising a vertix portion, a first leg and a second leg, said legs being joined by said vertex portion, a first end integral with and adjacent to said first leg of said V-shaped portion and configured to frictionally engage said housing for attaching said mounting spring to the ventilator, and a second end extending from said second leg of said V-shaped portion and being upwardly curved for sliding engagement with the ventilator; said second leg having a steeper slope than said first leg relative to said first and second ends; and whereby when said mounting spring is attached to the ventilator and the ventilator is inserted into the walled opening, said V-shaped portion substantially flattens and applies pressure against the walled opening sufficient to secure the ventilator within the walled opening.

17. The combination of a ventilator and a mounting spring as in claim 16, wherein:

said ventilator peripheral flange has a top plan surface, a side edge surface and a bottom plan surface; and wherein said first end of said mounting spring extends substantially perpendicularly relative to said first leg and extends in the same direction as said vertex portion, said first end forming a generally U-shaped portion fitting around a portion of said peripheral flange of said ventilator.

18. The combination of a ventilator and a mounting spring as in claim 16, wherein:

said ventilator has at least one indentation in at least one of said housing walls and a resilient gripping member biased toward and resting against said indentation; and said first end of said spring having a curved portion shaped to correspond to the curvature of said indentation of said ventilator housing wall, said curved portion having a convex surface pointing opposite to said vertex portion of said V-shaped portion, said curved portion of said mounting spring being adapted to be inserted between said indentation and said gripping member.

19. The combination of a ventilator and a mounting spring as in claim 16, wherein:

said collar defines a slot therein; and said first end of said mounting spring has a straight portion for insertion into said collar slot, said straight portion having at least one resilient flap portion for pressing against a surface said collar defining said slot.

20. The combination of a ventilator and a mounting spring as in claim 16, wherein:

said second end of said spring is formed to slide along the surface of a housing wall of the ventilator as said V-shaped portion substantially flattens upon insertion of said ventilator attached to said spring, within the walled opening.

* * * * *